US009573003B2

(12) United States Patent
Grunert et al.

(10) Patent No.: US 9,573,003 B2
(45) Date of Patent: Feb. 21, 2017

(54) TUMBLE DRYER WITH PASSIVE EXTINGUISHING SYSTEM

(71) Applicant: BSH HAUSGERÄTE GMBH, Munich (DE)

(72) Inventors: Klaus Grunert, Berlin Reinickendorf (DE); Günter Steffens, Dallgow-Döberitz (DE)

(73) Assignee: BSH Hausgeräte GmbH, München (DE)

( * ) Notice: Subject to any disclaimer, the term of this patent is extended or adjusted under 35 U.S.C. 154(b) by 786 days.

(21) Appl. No.: 13/680,167

(22) Filed: Nov. 19, 2012

(65) Prior Publication Data

US 2013/0174441 A1 Jul. 11, 2013

(30) Foreign Application Priority Data

Dec. 1, 2011 (DE) ..... 10 2011 087 608

(51) Int. Cl.
*F26B 13/10* (2006.01)
*A62C 3/00* (2006.01)
(Continued)

(52) U.S. Cl.
CPC ..... *A62C 3/00* (2013.01); *D06F 58/20* (2013.01); *D06F 58/28* (2013.01); *A62C 37/14* (2013.01); *D06F 2058/2858* (2013.01)

(58) Field of Classification Search
USPC ..... 169/34, 35, 36, 37, 38; 34/524
See application file for complete search history.

(56) References Cited

U.S. PATENT DOCUMENTS 2,470,043 A * 5/1949 Monsarrat ..... F26B 11/181 169/60
4,167,974 A * 9/1979 Job ..... A62C 37/14 169/38

(Continued)

FOREIGN PATENT DOCUMENTS

GB 2 205 037 A * 4/1987 ..... A62C 3/16
GB 2205037 A * 11/1988 ..... A62C 3/16

OTHER PUBLICATIONS

Report of Examination DE 10 2011 087 608.1.

*Primary Examiner* — Jorge Pereiro
*Assistant Examiner* — Wes Anderson, Jr.
(74) *Attorney, Agent, or Firm* — Jordan IP Law, LLC; Todd A. Vaughn

(57) ABSTRACT

A tumble dryer includes a drum receiving laundry to be dried and a container accommodating an extinguishing agent, with the drum and the container being connected by a first line. A first temperature-activated valve is arranged in the first line in thermal contact with the interior of the drum and provided to close the container and to open automatically at a temperature produced by a fire. Further connected to the container is a second line which has a mouth feeding into a region of a base plate of the tumble dryer. A second temperature-activated valve is configured to close the second line in a region of the mouth and to open automatically at the temperature produced by the fire. The first and second valves are hereby positioned in such a way that either the first valve or the second valve opens automatically at the temperature produced by the fire.

20 Claims, 2 Drawing Sheets

(51) Int. Cl.

| | |
|---|---|
| ***D06F 58/20*** | (2006.01) |
| ***D06F 58/28*** | (2006.01) |
| *A62C 37/14* | (2006.01) |

(56) References Cited

U.S. PATENT DOCUMENTS

| | | | | |
|---|---|---|---|---|
| 6,112,821 | A * | 9/2000 | Yokoi | A62C 37/09 169/37 |
| 6,745,495 | B1 * | 6/2004 | Riddle | D06F 58/28 34/493 |
| 2002/0184786 | A1 * | 12/2002 | Miller, II | D06F 58/20 34/132 |
| 2003/0010509 | A1 * | 1/2003 | Hoffman | A62C 3/04 169/56 |
| 2008/0276659 | A1 * | 11/2008 | Bae | D06F 39/008 68/5 C |
| 2009/0159301 | A1 | 6/2009 | Chatot et al. | |
| 2010/0175898 | A1 * | 7/2010 | Steinicke | A62C 3/00 169/46 |
| 2010/0206016 | A1 * | 8/2010 | Bae | D06F 58/203 68/5 C |

* cited by examiner

TUMBLE DRYER WITH PASSIVE EXTINGUISHING SYSTEM

BACKGROUND OF THE INVENTION

The present invention relates to a tumble dryer and here in particular to a domestic tumble dryer as claimed in the preamble of the independent claim.

It repeatedly occurs with tumble dryers that certain small items, such as lint or fluff or other impurities, such as wear material from drive belts, can collect and form deposits in the drum or in the floor region of the housing. On reaching a certain temperature it may occur that these items catch fire. This is to be avoided. In a number of countries, there are already appropriate test procedures in force, or are intended to be brought into effect shortly, such as to prove that fire cannot break out in the tumble dryer. To this end, for example, in the USA as from 2013 tests will be conducted to ensure that a cloth laid over the tumble dryer cannot ignite during the test.

Manufacturers of tumble dryers are therefore concerned with being able to offer tumble dryers whereby a fire in the interior of the tumble dryer can be actively extinguished, or whereby at least the spreading of the fire to the outside can be prevented. In this situation the principle is known from DE 10 2007 061 521 A1 of undertaking active fighting of a fire by extinguishing it with water or other chemicals from a container arranged above the drum, after the extinguishing process has been activated by a temperature sensor. Such a solution, however, is as a rule dependent on a functioning power supply for the operation of the temperature sensor, the control technology and evaluation circuitry relating to it, as well as other devices if appropriate.

As an alternative, passive fighting of a fire is also possible, inasmuch as no easily combustible components made of plastics materials are used any longer, but only fire-resistant plastics, metals, or other materials. This is only possible, however, if increased manufacturing costs are taken into account.

From DE 38 09 754 A1 a fire extinguishing device for tumble dryers is known, as claimed in the preamble of claim 1. A container is provided beneath the worktop, with several cells in which an extinguishing agent is stored. Holes are provided on the underside of the cells, which are closed with the aid of a protective sheath or destructible membrane and are destroyed in the presence of flames or at a temperature above a predetermined limit temperature. Upon the limit temperature being reached, the extinguishing agent is therefore released and falls downwards in order to extinguish the fire which has broken out. According to an alternative embodiment, a container subjected to pressure is provided with an extinguishing agent, from which lines lead to points which are regarded as subject to the risk of fire. In the event of the onset of a fire or the occurrence of a high temperature, the lines can melt and are therefore interrupted and opened respectively. The extinguishing agent is thereby released.

From US 2010/0175898 A1 a fire protection device for a tumble dryer is known, comprising a device for the detection of a temperature inside the tumble dryer. The device is connected to an extinguishing agent releasing device, to which a pulse can be issued by the temperature detection device if a specific temperature is reached. As a result, extinguishing agent can be released by the extinguishing agent releasing device.

The tumble dryers known from the aforecited publications are disadvantageous however in that a relatively large amount of water or extinguishing agent must be retained in order for an outbreak of fire to be reliably extinguished.

It is an object of the present invention to propose a tumble dryer, such as, in particular, a domestic tumble dryer, with which a fire which may break out in the drum or outside cannot spread from the drum and will be extinguished, as far as possible automatically, without a connection to the power supply being necessary. This should be possible with the smallest possible store of extinguishing agent.

BRIEF SUMMARY OF THE INVENTION

This object is achieved with a tumble dryer as claimed in the independent claim. Advantageous developments of the invention are the object of the dependent claims, the following description, and the appended drawings.

A tumble dryer according to the invention comprises a drum intended to accommodate the laundry which is to be dried, as well as a container which can accommodate or already contains extinguishing agent, which as a rule is capable of flowing. The outflow from the container is closed by means of a first temperature-activated valve, which opens automatically at a temperature such as is produced, for example, by a fire, or correspondingly high temperatures. The tumble dryer according to the invention is characterized in that the container is connected by means of a first a line to the interior of the drum, and the valve is arranged in the first line in such a way that it is in good thermal contact with the interior of the drum. This good thermal contact can be attained, among other methods, by the first valve being arranged in the immediate vicinity of the drum or even inside the drum. According to the invention, provision is also made for a second line connected to the container, which opens in the region of a base plate of the tumble dryer, and is closed in the region of its mouth by a second temperature-activated valve. This second valve is also arranged in such a way that it opens automatically when a high temperature produced by a fire or similar cause is reached. As a rule, it may be assumed that a fire or a substantial temperature increase will not occur simultaneously at two places, wherein it may be assumed that these places will be predominantly in the region of the base plate and inside the drum. In order not to have to provide for or store so much extinguishing agent that a possible fire at two places can be reliably extinguished, the arrangement according to the invention is such that either the first valve or the second valve opens automatically at the temperature produced by the fire. It is therefore sufficient for extinguishing agent to be provided only in that quantity which is required to extinguish a fire at one place, and not at two or even more places. The container, together with the lines and the valves, forms an extinguishing system.

The tumble dryer according to the invention, with the extinguishing system described, operates passively, i.e. no electrical, electronic, or control technology is present which would make connection to a power supply necessary.

In order to ensure that always only the first valve or the second valve opens automatically, it is preferred that the mouth of the second line is located at least 5 cm, for preference at least 10 cm, and for particular preference at least 20 cm from the drum, into which the line which is closed by the first valve opens. In other words, this means that by maintaining a certain minimum distance between the two valves it can be ensured that the valve in the vicinity of which the fire has developed will open due to the higher temperatures prevailing there, while the other valve, which is still located in a region of low temperature, remains closed. As an alternative, it would also be possible, for example, for both the valves to be arranged such that they open automatically at different temperatures, if this is technically feasible with corresponding analyses of the temperature distributions of different locations at which a fire breaks out. It is also conceivable for the two valves to be designed in such a way that as soon as the first valve has opened the extinguishing agent will be released so rapidly, and therefore the pressure drop will be so sharp, that the second valve, not yet opened, remains closed. This can of course only be achieved if, for the automatic opening of the valves, not only a temperature component but also a pressure component is required.

According to an advantageous embodiment of the invention, the first line and the second line do not run directly from the container but are both a continuation of a third line, which in turn runs from the container. By way of this measure, less material is used for the manufacture of the lines.

It advantageous if the first valve and the second valve comprise a thermo-bulb. A thermo-bulb is a glass cylinder filled with a fluid which, upon reaching a specific temperature, as in the present case the temperature caused by an outbreak of fire, bursts, due to the fact that the fluid expends so vigorously due to the rise in temperature that the radial circumferential walls of the glass cylinder break. These thermo-bulbs are designed in such a way that they exhibit a perceptibly higher stability in the axial direction. Upon the bursting of the glass cylinder, a valve opens in the axial direction. In the present case, extinguishing agent can flow through the opened valve out of the line concerned. The glass cylinder is arranged in this process in such a way that it can accommodate perceptibly higher forces in the axial direction, in order, for example, to keep the valve closed under water pressure, than in the radial direction, in which it bursts at the rise in temperature.

It is advantageous if the first line in the front end shield, which is provided for mounting the drum, opens into the interior of the drum. This allows for a structurally simple design for the guiding of the extinguishing agent into the drum. In this situation, it is preferred for the first line to open above the mid-axis of the drum, and in this case, preferably, in the region of the upper end of the drum. The water which is jetted or sprayed into the drum in the event of an outbreak of fire is then, due to the force of gravity, distributed approximately uniformly over the drum.

According to an advantageous embodiment of the invention, the container is arranged on the underside of the upper delimitation of the tumble dryer, which is frequently designed as a worktop. In this case, no provision needs to be made for any other pump or pressure application device for the extinguishing agent in order to conduct it, if required, the same to the target location, gravity can be used instead. Naturally, an appropriate pressure application device can additionally be provided, such as, for example, a pressure cartridge, which can then be designed with lower capacity. The container can advantageously be arranged with an adequately dimensioned pump/pressure cartridge at any desired location in or at the tumble dryer.

It may be advantageous if the container exhibits a closable filling opening for the extinguishing agent. A user can then regularly check, for example, that the container is completely filled with extinguishing agent. This configuration also makes it possible for a tumble dryer according to the invention to be transported to the place of use without being filled with extinguishing agent, and for the container to only then be filled with extinguishing agent on site. The possibility of filling the container by means of the filling opening offers the further advantage that the container can be refilled if the extinguishing system described has become active, without the entire container with its associated lines and valves etc. needing to be replaced. This is of advantage in particular if the damage caused by the fire is so delimited that the further use of the tumble dryer after the actuation of the extinguishing system and replacement or repair of the damaged parts make the reuse of the tumble dryer worthwhile.

It is an advantage of the present invention that the container must exhibit a volume of a maximum of some three to four liters, since experience has shown this to be sufficient for the complete extinguishing of a fire which has broken out.

According to an advantageous embodiment of the tumble dryer according to the invention, the container is already filled by the manufacturers with water, with the addition of an extinguishing additive to enhance the extinguishing effect. As a result, the possibility can be excluded of a tumble dryer according to the invention inadvertently being taken into operation without being filled with extinguishing agent, without this having to be detected, for example, by electronic monitoring sensor means.

BRIEF DESCRIPTION OF THE DRAWINGS

Further advantages, features, and special details of the invention are to be derived from the following description of advantageous embodiments of the invention, making reference to the figures of the appended drawings, in which.

DETAILED DESCRIPTION OF EXEMPLARY EMBODIMENTS OF THE PRESENT INVENTION

Figure 1:
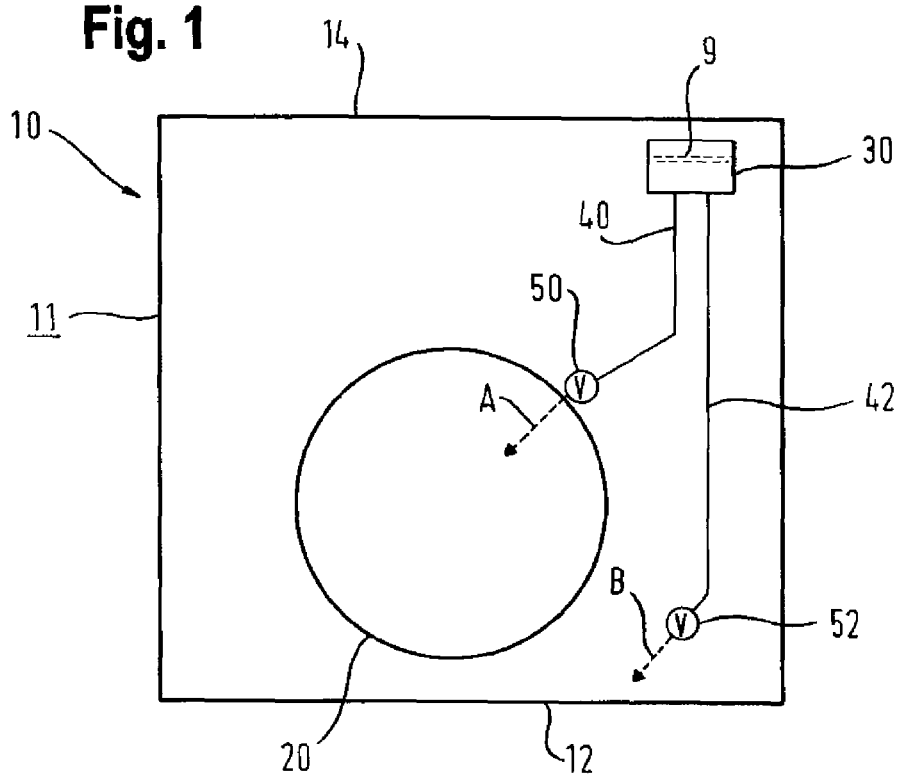
FIG. 1 shows a side view in schematic representation of a first advantageous embodiment.

FIG. 1 shows a schematic representation of a first embodiment of the tumble dryer 10. Located in a housing 11, which is delimited underneath by a base plate 12 and above by a worktop 14, is a drum 20, into which laundry which is to be dried is introduced. Located above the drum, in the region of the underside of the worktop 14, is a container 30, which when in operation contains an extinguishing agent 9, such as water. From the container 30 a first line 40 leads downwards into the interior of the drum. The lower end of the line 40, facing away from the container 30, is closed off by a first valve 50, which for reasons of easy overview is represented as being somewhat outside the drum 20. The first valve 40 is installed in this situation in such a way that it exhibits a good thermal contact with the drum 20. This then ensures that, if the drum 20 or its interior respectively is heated, the first valve 50 will "feel" this temperature rise, and, respectively, react to this accordingly. A second line 42 is additionally provided, which leads from the container 30 until shortly above the base plate 12, and opens there. The second line 42 is closed by a second valve 52. The two valves 50 and 52 are designed respectively as temperature-activated valves, such as can be produced by means of thermo-bulbs.

A detailed description of thermo-bulbs is provided later by reference to FIG. 4. The second valve 52 is arranged at a specific distance from the drum 20, such that it reacts less to the temperature of the drum 20, and rather to the ambient temperature in the region of the base plate 12.

Accordingly, as soon as, for example, a fire breaks out in the drum 20, and the temperature accordingly exceeds a specific limit value, the first valve 50 opens, activated by this limit value being exceeded, and extinguishing agent 9 can flow out of the container 30 into the drum 20. The spraying or jetting of extinguishing agent 9 into the drum 20 is indicated schematically by an arrow A with a broken line. Since the fire has developed in the drum 20, the temperature rises inside the drum 20 much more substantially than outside, such as, in particular, in the region of the base plate 12. Accordingly, the second valve 52 will not open, since, as already explained, this has been arranged far enough away from the drum 20. If, by contrast, a fire develops in the region of the base plate 12, then the second valve 52 "feels" this temperature rise much more quickly and more strongly than the first valve 50, and actuates when the temperature limit value is exceeded, i.e. it opens. The extinguishing agent 9 can then flow out and extinguish the fire in the region of the base plate 12. The emergence of the extinguishing agent 9 from the second valve 52 at the end of the second line 42 is indicated schematically by an arrow B. Due to the fact that the first valve 50 is subjected to a lower temperature, it remains closed. Accordingly, all the extinguishing agent is conducted to the respective location of the fire, and is not wasted at a place at which it is not required.

Figure 2:
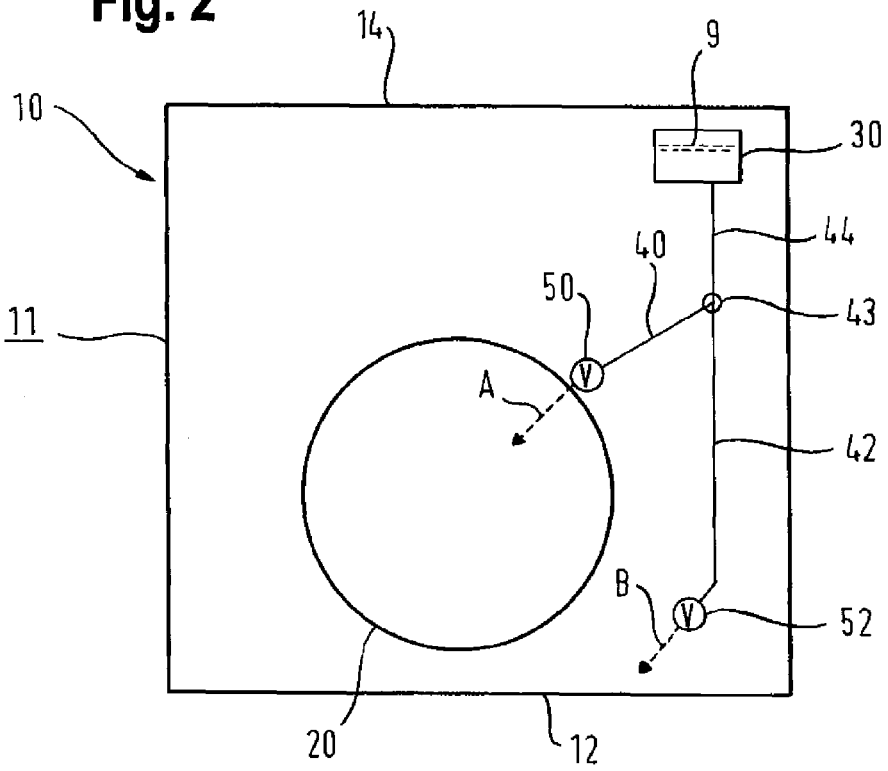
FIG. 2 shows a side view in schematic representation of a second advantageous embodiment.

FIG. 2 shows in schematic form a second embodiment of the tumble dryer 10. The explanations provided in respect of the first embodiment from FIG. 1 and the reference numbers used apply also to the second embodiment, unless explicitly stated otherwise. In order to avoid repetition, it is predominantly the differences in respect of the first embodiment which are explained. As with the first embodiment, two lines 40, 42 with corresponding valves 50, 52 are provided, which open into the drum 20 or in the region of the base plate 12. Conversely to the first embodiment, the two lines 40, 42 are not fully separated from one another, however, but branch at a branch point 43 of a line 44, which in turn leaves from the container 30. Accordingly, only one line needs to be connected to the container 30.

Figure 3:
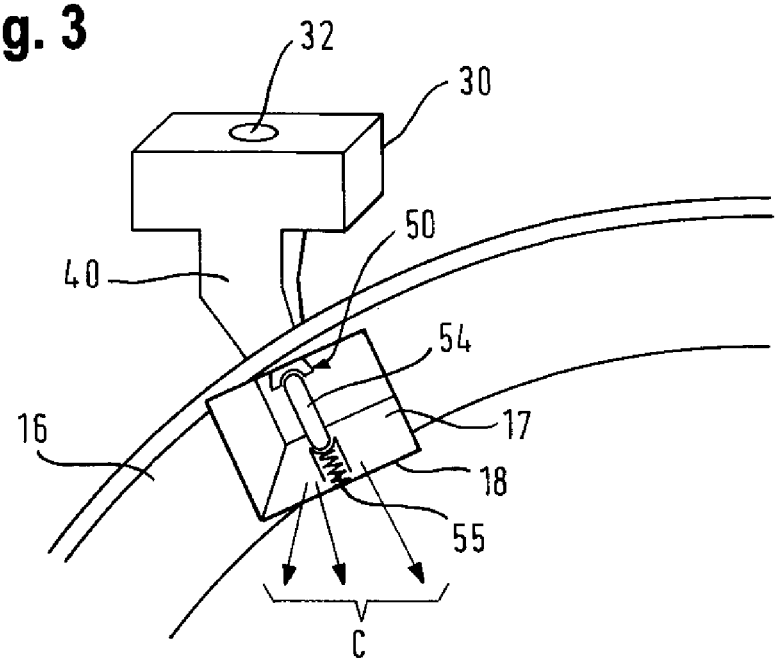
FIG. 3 shows in a perspective representation the arrangement of a container and a valve on the end shield of a tumble dryer.

FIG. 3 shows in a perspective view another end shield 16 of a tumble dryer 10. Arranged above this end shield 16, i.e. also above the drum 20, not shown, is the container 30 for the extinguishing agent 9. The container 30 exhibits on its upper side an opening 32, through which it can be filled. The opening 32 is closable by means of a cover, not shown. Connected to the underside of the container 30 is a line 40, which opens into a valve chamber 17 which is provided in the end shield 16. The lower end of the line 40 is closed by a valve 50 (see FIG. 4) and held in the closed position by a thermo-bulb 54 by tensioning springs 55. The underside of the valve chamber 17 serves as an impact surface 18, onto which, after the opening of the valve 50, the extinguishing agent 9 impacts and is nebulized or jetted, such that it is nebulized or jetted into the interior of the drum 20 (of which only the end shield 16 is represented). This nebulizing process is represented symbolically by an arrow C.

Figure 4:
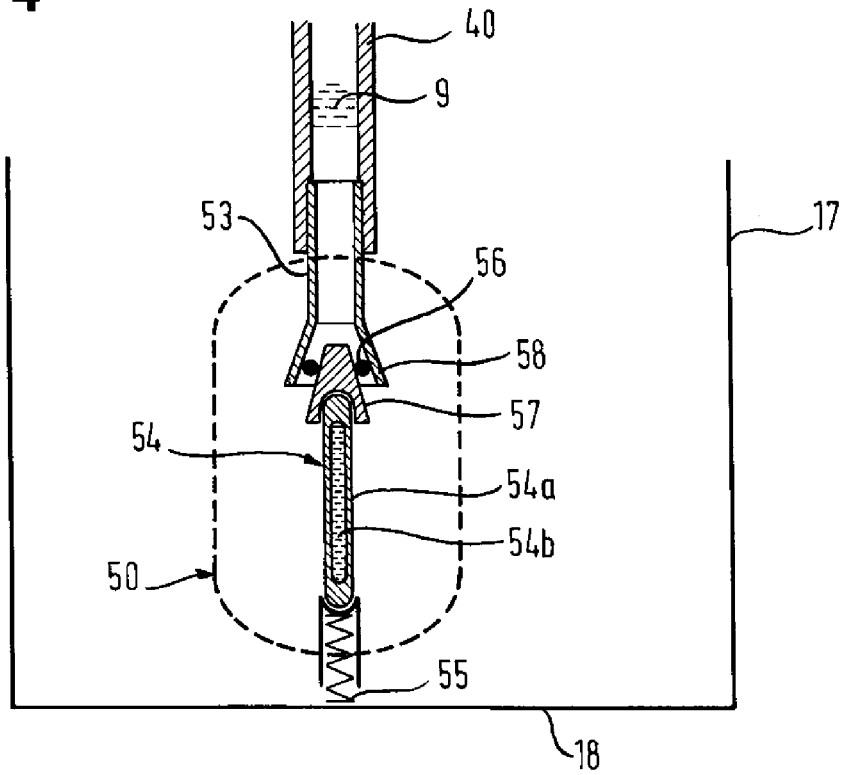
FIG. 4 shows a sectional representation of the structure of a thermo-bulb.

FIG. 4 shows a thermo-bulb 54 as a component part of the first valve 50, as installed in the first line 40. The technical design of the second valve 52 may of course be of the same or similar arrangement. A tube 53 is inserted into the end of the first line 40, facing away from the container, the free end of which forms a conical or funnel-shaped widening region 58. A conical element 57 is inserted into the conical widening region 58, wherein a ring seal 56 provides for a tight closure of the conical widening region 58 by means of the conical element 57.

The valve 50 is represented as arranged in the valve chamber 17. Arranged at the base of the valve chamber 17, which forms an impact surface 18, is a tensioning spring 55. Arranged between the tensioning spring 55 and the lower end of the conical element 57, engaging in a depression at its lower end, is a thermo-bulb 54. The tensioning spring 55 presses the thermo-bulb 54 upwards and thereby holds the valve 50 closed against the pressure of the extinguishing agent 9. The thermo-bulb 54 comprises a glass tube 54*a*, in which a fluid 54*b* is contained. In addition, in the fluid 54*b* of the glass tube 54*a*, is an air bubble, not shown. The glass tube 54*a* is arranged in such a way that in the axial direction (according to FIG. 4, in the direction from top to bottom) it can absorb substantially greater forces without bursting than in the radial direction (in FIG. 4 in the direction from left to right). If the fluid 54*b* is heated due to a temperature rise, such as, for example, due to a fire, it expands and compresses the air bubble. On reaching a specific limit value for the temperature, the pressure in the interior of the glass tube 54*a* becomes so strong that it bursts (in the radial direction). Due to the pressure in the extinguishing agent 9, the conical element 57 is spun downwards, and the extinguishing agent 9 flows downwards and impacts on the impact surface 18, from where it is nebulized or jetted and enters the drum 20 (approximately perpendicular to the plane of the drawing).

As a result of this, the situation is achieved, without a connection to the electricity supply, in a technically simple, economical, and reliable manner, that the valve 50, on reaching or exceeding a limit value of the ambient temperature, opens spontaneously, i.e. automatically, and allows for the extinguishing procedure for the fire to be carried out.

Naturally, the invention described heretofore is not restricted to the two embodiments described in detail. The different variants of the extinguishing system can be used both with condensation dryers as well as with exhaust air dryers, and in each case guarantee a reliable and automatic extinguishing of a fire, should one occur, not requiring any influence from the outside. Since no connection to the mains electricity supply or the provision of a battery etc. is required for operation of or for the maintaining of readiness of the extinguishing system, the reliability of the extinguishing system against failures is very high.

It is to be noted that features of the invention described in relation to individual embodiments, such as the design and arrangement of the container and the valves and lines, can also be provided in other embodiments, individually or cumulatively, unless indicated otherwise or inherently not feasible for technical reasons.

What is claimed is:

1. A tumble dryer, comprising:

a drum;

an extinguishing system including, a container to accommodate an extinguishing agent;

a first line connecting the container with an interior of the drum; and a first valve assembly in the first line to detect a temperature in the interior of the drum so as to automatically open and permit flow of the extinguishing agent from the container into the interior of the drum when the detected temperature exceeds a specific limit value, the first valve assembly including a first valve chamber, a first tube arranged in an end of the first line, a first conical element inserted into the first tube, a first spring arranged at a base of the first valve chamber which forms a first impact surface, and a first valve having a first thermo-bulb to detect the temperature, and which is arranged longitudinally between the first spring and a lower end of the first conical element such that the first spring is to press the first thermo-bulb upwards and thereby hold the first valve closed against the pressure of the extinguishing agent.

2. The tumble dryer of claim 1, wherein the first thermo-bulb is to engage in a depression in the lower end of the first conical element.

3. The tumble dryer of claim 1, wherein the first tube has a first conical widening region into which the first conical element is inserted, and a first ring seal is to provide for a closure of the first conical widening region.

4. The tumble dryer of claim 1, further comprising a second line connected to the container and feeding into a region of a base plate of a housing of the tumble dryer.

5. The tumble dryer of claim 4, further comprising a second valve assembly arranged in the second line to detect a temperature in a region of the base plate so as to automatically open and permit flow of the extinguishing agent from the container into the region of the base plate when the detected temperature exceeds a specific limit value.

6. The tumble dryer of claim 5, wherein the second valve assembly comprises a second valve chamber, a second tube arranged in an end of the second line, a second conical element inserted into the second tube, a second spring arranged at a base of the second valve chamber which forms a second impact surface, and a second valve having a second thermo-bulb to detect the temperature, and which is arranged between the second spring and a lower end of the second conical element.

7. The tumble dryer of claim 6, wherein the second tube has a second conical widening region into which the second conical element is inserted, and a second ring seal is to provide for a closure of the second conical widening region.

8. The tumble dryer of claim 6, wherein the second thermo-bulb is to engage in a depression in the lower end of the second conical element.

9. A dryer, comprising:

a housing which is delimited underneath by a base plate;

a drum;

a front end shield for mounting the drum in the housing;

an extinguishing system including, a container arranged in the housing to accommodate an extinguishing agent, and connected with an interior of the drum via a first line, the container having a closable filling opening for the extinguishing agent; and a first valve assembly in thermal contact with the interior of the drum, and which detects a temperature in the interior of the drum so as to automatically open and permit flow of the extinguishing agent from the container into the interior when the detected temperature exceeds a specific limit value, the first valve assembly including a first valve chamber, a first tube arranged in an end of the first line facing away from the container, a first conical element inserted into the first tube, a first spring arranged at and contacting a base of the first valve chamber which forms a first impact surface, and a first valve having a first thermo-bulb to detect the temperature, and which is arranged longitudinally between the first spring and a lower end of the first conical element such that the first spring is to press the first thermo-bulb upwards and thereby hold the first valve closed against the pressure of the extinguishing agent.

10. The dryer of claim 9, wherein the first thermo-bulb is to engage in a depression in the lower end of the first conical element.

11. The dryer of claim 9, wherein the first tube has a first conical widening region into which the first conical element is inserted, and a first ring seal is to provide for a closure of the first conical widening region.

12. The dryer of claim 9, further comprising a second line connected to the container and feeding into a region of the base plate.

13. The dryer of claim 12, further comprising a second valve assembly, arranged in the second line in thermal contact with a region of the base plate, and which detects a temperature in the region of the base plate so as to automatically open and permit flow, by force of gravity, of the extinguishing agent from the container into the region of the base plate when the detected temperature exceeds a specific limit value.

14. The dryer of claim 13, wherein the second valve assembly comprises a second valve chamber, a second tube arranged in an end of the second line, a second conical element inserted into the second tube, a second spring arranged at and contacting a base of the second valve chamber which forms a second impact surface, and a second valve having a second thermo-bulb to detect the temperature, and which is arranged between the second spring and a lower end of the second conical element.

15. The dryer of claim 14, wherein the second tube has a second conical widening region into which the second conical element is inserted, and a second ring seal is to provide for a closure of the second conical widening region.

16. A dryer, comprising:

a housing which is delimited underneath by a base plate;

a drum;

an extinguishing system including, a container arranged above the drum to accommodate an extinguishing agent, the container having a closable filling opening for the extinguishing agent;

a first line directly connected to the container;

a second line branching off the first line to connect the container with a first region in the housing; and a first valve assembly arranged in the second line to detect a temperature in the interior of the drum so as to automatically open and permit flow of the extinguishing agent from the container into the interior when the detected temperature exceeds a specific limit value, the first valve assembly including a first valve chamber, a first tube arranged in an end of the second line, a first conical element inserted into the first tube, a first spring arranged at and contacting a base of the first valve chamber which forms a first impact surface, and a first valve having a first thermo-bulb to detect the temperature, and which is arranged longitudinally between the first spring and a lower end of the first conical element such that the first spring is to press the first thermo-bulb upwards and thereby hold the first valve closed against the pressure of the extinguishing agent.

17. The dryer of claim 16, further comprising a third line branched off the first line to connect the container with a second region in the housing, the second region being spaced apart from the first region.

18. The dryer of claim 17, further comprising a second valve assembly, arranged in the second line in thermal contact with a region of the base plate, and which detects a temperature in the region of the base plate so as to automatically open and permit flow, by force of gravity, of the extinguishing agent from the container into the region of the base plate when the detected temperature exceeds a specific limit value.

19. The dryer of claim 18, wherein the second valve assembly comprises a second valve chamber, a second tube arranged in an end of the second line, a second conical element inserted into the second tube, a second spring arranged at and contacting a base of the second valve chamber which forms a second impact surface, and a second valve having a second thermo-bulb to detect the temperature, and which is arranged between the second spring and a lower end of the second conical element.

20. The dryer of claim 19, wherein the second tube has a second conical widening region into which the second conical element is inserted, and a second ring seal is to provide for a closure of the second conical widening region.

* * * * *